US011173099B2

(12) United States Patent
Venti et al.

(10) Patent No.: US 11,173,099 B2
(45) Date of Patent: Nov. 16, 2021

(54) SYSTEM FOR STORAGE, COOLING AND MONITORING OF BREAST MILK

(71) Applicant: Pippy Sips LLC, Philadelphia, PA (US)

(72) Inventors: Amber Lee Venti, Philadelphia, PA (US); Joseph Alan Venti, Philadelphia, PA (US)

(73) Assignee: Pippy Sips LLC, Philadelphia, PA (US)

( * ) Notice: Subject to any disclaimer, the term of this patent is extended or adjusted under 35 U.S.C. 154(b) by 109 days.

(21) Appl. No.: 16/705,689

(22) Filed: Dec. 6, 2019

(65) Prior Publication Data

US 2020/0179233 A1 Jun. 11, 2020

Related U.S. Application Data

(60) Provisional application No. 62/776,574, filed on Dec. 7, 2018.

(51) Int. Cl.

| | |
|---|---|
| ***A61J 9/00*** | (2006.01) |
| ***A61J 9/02*** | (2006.01) |
| ***F25D 3/08*** | (2006.01) |
| ***A47G 23/04*** | (2006.01) |
| ***A61J 9/06*** | (2006.01) |
| ***A61J 9/08*** | (2006.01) |
| *A61J 11/00* | (2006.01) |

(52) U.S. Cl.

CPC ..... *A61J 9/02* (2013.01); *A61J 9/003* (2013.01); *A61J 9/06* (2013.01); *A61J 9/085* (2013.01); *A61J 11/00* (2013.01); *A61J 2200/44* (2013.01); *A61J 2200/50* (2013.01); *F25D 2331/803* (2013.01)

(58) Field of Classification Search

CPC .... A47J 36/28; A47J 36/2444; A47J 2202/00; A47J 41/00; A61J 9/02; A61J 9/003; A61J 9/06; A61J 9/085; A61J 11/00; A61J 2200/44; A61J 2200/50; F25D 3/107; F25D 2331/803; F25D 2331/805

USPC ..... 215/11.1–11.6, 6; 62/457.3, 457.4, 372; 426/109; 220/574, 574.2, 592.01, 592.17; 374/150, 141

See application file for complete search history.

(56) References Cited

U.S. PATENT DOCUMENTS 59,687 A * 11/1866 Waldstein ..... F25D 3/00 215/6

544,219 A * 8/1895 Godet ..... B65D 1/04 215/6

(Continued)

*Primary Examiner* — Gideon R Weinerth

(74) *Attorney, Agent, or Firm* — Riverside Law LLP

(57) ABSTRACT

A system for storing breast milk includes a container having a top opening and a bottom recess extending into an interior of the container towards the top opening. A container cap is configured to attach to the container and cover the top opening. The container cap includes a probe thermometer having a sensing tip positioned above the bottom recess when the container cap is attached to the container. A non-insulated cooling base has a protrusion configured to mate within the recess when the container is resting on the base. An insulated shell assembly includes a top and bottom configured to connect to each other, wherein the shell assembly is configured to at least partially encapsulate the container, the container cap and the cooling base.

17 Claims, 5 Drawing Sheets

(56) References Cited

U.S. PATENT DOCUMENTS 730,337 A * 6/1903 Bonnefont ..... A47G 19/2288 215/6
1,221,335 A * 4/1917 Kline ..... A61J 9/003 215/13.1
1,731,539 A * 10/1929 Pearson ..... F25D 3/14 62/371
1,841,516 A * 1/1932 Andrews ..... A61J 9/02 215/11.2
2,190,606 A * 2/1940 Pedder ..... B65D 79/02 215/228
2,319,101 A * 5/1943 Anderson ..... B65D 23/16 374/150
2,357,477 A * 9/1944 Killman ..... A61J 9/02 374/150
2,409,279 A * 10/1946 Hiller ..... F25D 3/08 62/371
2,505,037 A * 4/1950 Frumkin ..... A61J 9/02 374/150
2,526,165 A * 10/1950 Smith ..... F25D 3/08 62/457.3
2,648,226 A * 8/1953 Finch ..... A61J 9/02 374/150
2,814,202 A * 11/1957 Frans ..... A61J 9/02 374/150
2,953,921 A * 9/1960 Muncheryan ..... A61J 9/02 374/204
2,981,108 A * 4/1961 Andersen ..... A61J 9/006 374/150
2,994,448 A * 8/1961 Sepe ..... A61J 9/08 215/395
3,147,888 A * 9/1964 Mooney ..... A47G 19/32 222/130
3,157,303 A * 11/1964 Siegel ..... A61J 9/0638 374/116
3,559,484 A * 2/1971 Kita ..... A61J 9/02 374/150
4,531,383 A * 7/1985 Zimmermann ..... A47J 41/0044 62/457.4
4,745,776 A * 5/1988 Clark ..... B65D 81/3886 62/372
4,989,415 A * 2/1991 Lombness ..... B65D 81/3886 62/372
5,044,173 A * 9/1991 Cheng ..... A47G 19/2288 62/372
5,467,877 A * 11/1995 Smith ..... A61J 9/00 215/11.1
5,553,941 A * 9/1996 Cope ..... A61J 9/02 215/11.2
5,597,087 A * 1/1997 Vinarsky ..... A45F 3/16 215/396
5,653,124 A * 8/1997 Weber ..... B65D 51/04 62/457.4
5,904,267 A * 5/1999 Thompson ..... B65D 81/3883 220/592.16
6,123,065 A * 9/2000 Teglbjarg ..... A47J 36/2411 126/263.09
6,134,894 A * 10/2000 Searle ..... B65D 1/165 62/293
D458,086 S * 6/2002 Marks ..... D7/605
6,415,624 B1 * 7/2002 Connors ..... B65D 21/0237 62/457.3
D469,664 S * 2/2003 Marks ..... D7/608
6,544,614 B1 * 4/2003 Huffer ..... G01K 11/12 428/40.1
6,786,062 B1 * 9/2004 Greenberg ..... F25D 3/08 62/457.4
6,938,793 B2 * 9/2005 Lerner ..... A47J 36/2494 220/574.2
7,010,935 B2 * 3/2006 Citrynell ..... A47G 19/2255 62/457.3
8,051,996 B1 * 11/2011 Amaya ..... A61J 9/008 215/6
D649,836 S * 12/2011 Dooley ..... D7/536
D673,468 S * 1/2013 Cooney ..... D10/60
D686,454 S * 7/2013 Roth ..... D7/523
2003/0012256 A1 * 1/2003 Burkholder ..... A47J 41/0094 374/150
2004/0065109 A1 * 4/2004 Metcalf ..... A47G 19/127 62/457.3
2004/0177642 A1 * 9/2004 Citrynell ..... A47G 19/2255 62/457.3
2005/0103739 A1 * 5/2005 Brown ..... F25D 3/08 215/6
2008/0197097 A1 * 8/2008 Montgomery ..... A61J 9/001 215/11.2
2008/0251063 A1 * 10/2008 Palena ..... A61J 9/02 126/263.09
2008/0279724 A1 * 11/2008 Dicarlo ..... A61J 9/00 422/400
2012/0293332 A1 * 11/2012 Rosenfeld ..... A47J 41/0094 340/584
2013/0247591 A1 * 9/2013 DeMasi ..... A61J 9/02 62/4
2013/0277327 A1 * 10/2013 Fong ..... A61J 9/08 215/11.5
2014/0054010 A1 * 2/2014 Peters ..... F25D 3/08 165/104.11
2014/0166672 A1 * 6/2014 Stroucken ..... F25D 3/08 220/592.01
2014/0284342 A1 * 9/2014 Hewitt ..... A47G 23/02 220/592.24
2015/0096916 A1 * 4/2015 Marseglia ..... A61J 11/00 206/499
2017/0245678 A1 * 8/2017 Wakeham ..... F25D 3/08
2019/0231121 A1 * 8/2019 Alexander ..... A47J 36/2433
2020/0025442 A1 * 1/2020 Yoskowitz ..... F25D 31/007
2020/0179233 A1 * 6/2020 Venti ..... A61J 9/06
2021/0077674 A1 * 3/2021 Marafko ..... A61M 1/062

* cited by examiner

SYSTEM FOR STORAGE, COOLING AND MONITORING OF BREAST MILK

CROSS-REFERENCE TO RELATED APPLICATIONS

This application claims priority to U.S. provisional application No. 62/776,574 filed on Dec. 7, 2018 and incorporated herein by reference in its entirety.

BACKGROUND OF THE INVENTION

Breast milk has numerous benefits to babies, including nutritional benefits by providing all the vitamins and nutrients the baby needs in the first six months of life, and disease-fighting benefits by providing substances that protect the baby from illness. The American Academy of Pediatrics recommends breast milk exclusively for no less than the first six months of life when possible. A pump may be used during the breastfeeding experience for one or several reasons, including to increase milk supply, to stimulate lactation, and to prevent engorgement. One of the more common reasons for a mom to pump is to make sure her baby has access to breastmilk during time apart, for example with the mother is at work, school, events or traveling.

Mothers are often given opportunities to pump away from home, such as at their jobs. While this is helpful, pumping away from home can present a number of obstacles. For example, pumping away from home requires planning and preparation ahead of time which can be stressful due to all of the components that need to be packed (e.g. pumps, battery packs, flanges, hoses, milk bottles, refrigeration means, etc.). Proper planning is not only time consuming, it is also sometimes not practical, for example if travel or time away from home is unexpected. Further, pumping away from home depends on having access to refrigeration means. In addition, even when a mother can pump away from home, transporting pumped milk can be stressful since it's difficult to know whether the milk is being sufficiently cooled. Generally, a system that can store and transport breast milk more effectively and for longer periods of time would provide more options and flexibility for mothers that need to pump away from home or take home-pumped breast milk on the go. Conventional systems are typically not sufficient for storage beyond 16 hours and require replenishment of ice cubes.

What is needed in the art is an improved handheld portal system for storing, cooling breast and monitoring breast milk that is simple to use while maximizing cooling speed and duration, and providing superior temperature monitoring functionality. The improved system should be lightweight, easy to clean, and have the capability to safely store milk for 24 hours or more without relying on replenishing cooling components such as ice cubes during that period.

SUMMARY OF THE INVENTION

A system for storing breast milk includes a container having a top opening and a bottom recess extending into an interior of the container towards the top opening; a container cap configured to attach to the container and cover the top opening, the container cap having a probe thermometer having a sensing tip positioned above the bottom recess when the container cap is attached to the container; a non-insulated cooling base having a protrusion configured to mate within the recess when the container is resting on the base; and an insulated shell assembly having a top and bottom configured to connect to each other, where the shell assembly is configured to at least partially encapsulate the container, the container cap and the cooling base. In one embodiment, the cooling base includes a single layer of material. In one embodiment, the material is stainless steel. In one embodiment, the shell assembly includes two or more layers of material. In one embodiment, the two or more layers include a stainless steel layer and a vacuum insulation layer. In one embodiment, the container cap includes a thermometer display configured to display a temperature reading measured from the sensing tip. In one embodiment, the shell top includes an opening configured to at least partially surround the display when the shell assembly is at least partially encapsulating the container, the container cap and the cooling base. In one embodiment, the shell top is configured to contact at least one of the container and container cap to seal an interior portion of the shell from atmosphere when the shell assembly is at least partially encapsulating the container, the container cap and the cooling base. In one embodiment, the shell top is configured to contact both the container and container cap to seal both top and bottom interior portions of the shell from atmosphere when the shell assembly is at least partially encapsulating the container, the container cap and the cooling base. In one embodiment, the sensing tip and bottom recess are separated by between 0.5 cm and 3 cm when the container cap is attached to the container. In one embodiment, the sensing tip and bottom recess are separated by between 0.5 cm and 2 cm when the container cap is attached to the container. In one embodiment, the sensing tip and bottom recess are separated by between 0.5 cm and 1 cm when the container cap is attached to the container. In one embodiment, the protrusion and recess are configured to extend at least 2 cm into the interior of the container when the container is resting on the cooling base. In one embodiment, the protrusion and recess are configured to extend at least 3 cm into the interior of the container when the container is resting on the cooling base. In one embodiment, the protrusion and recess are configured to extend at least 4 cm into the interior of the container when the container is resting on the cooling base. In one embodiment, the protrusion and recess are configured to extend at least 5 cm into the interior of the container when the container is resting on the cooling base. In one embodiment, the protrusion and recess are configured to extend into at least 15% of the height of the interior of the container when the container is resting on the cooling base. In one embodiment, the protrusion and recess are configured to extend into at least 20% of the height of the interior of the container when the container is resting on the cooling base. In one embodiment, the protrusion and recess are configured to extend into at least 25% of the height of the interior of the container when the container is resting on the cooling base. In one embodiment, the protrusion and recess are configured to extend into at least 30% of the height of the interior of the container when the container is resting on the cooling base.

In one embodiment, a system for storing breast milk includes a container having a top opening and a bottom recess extending into an interior of the container towards the top opening; a container cap configured to attach to the container and cover the top opening; a non-insulated cooling base having a protrusion configured to mate within the recess when the container is resting on the base; and an insulated shell assembly having a top and bottom configured to connect to each other, where the shell assembly is configured to at least partially encapsulate the container, the container cap and the cooling base. In one embodiment, the container cap includes a probe thermometer having a sensing tip positioned above the bottom recess when the container cap is attached to the container.

In one embodiment, a system for storing breast milk includes a container having a top opening; a container cap configured to attach to the container and cover the top opening, the container cap including a probe thermometer having a sensing tip positioned within an interior of the container when the container cap is attached to the container and a thermometer display configured to display a temperature reading measured from the sensing tip; a non-insulated cooling base; and an insulated shell assembly having a top and bottom configured to connect to each other, wherein the shell assembly is configured to at least partially encapsulate the container, the container cap and the cooling base; where the shell top includes an opening configured to at least partially surround the display, and is configured to contact at least one of the container and container cap to seal an interior portion of the shell from atmosphere when the shell assembly is at least partially encapsulating the container, the container cap and the cooling base.

BRIEF DESCRIPTION OF THE DRAWINGS

The foregoing purposes and features, as well as other purposes and features, will become apparent with reference to the description and accompanying figures below, which are included to provide an understanding of the invention and constitute a part of the specification, in which like numerals represent like elements, and in which.

DETAILED DESCRIPTION OF THE INVENTION

Figure 1:
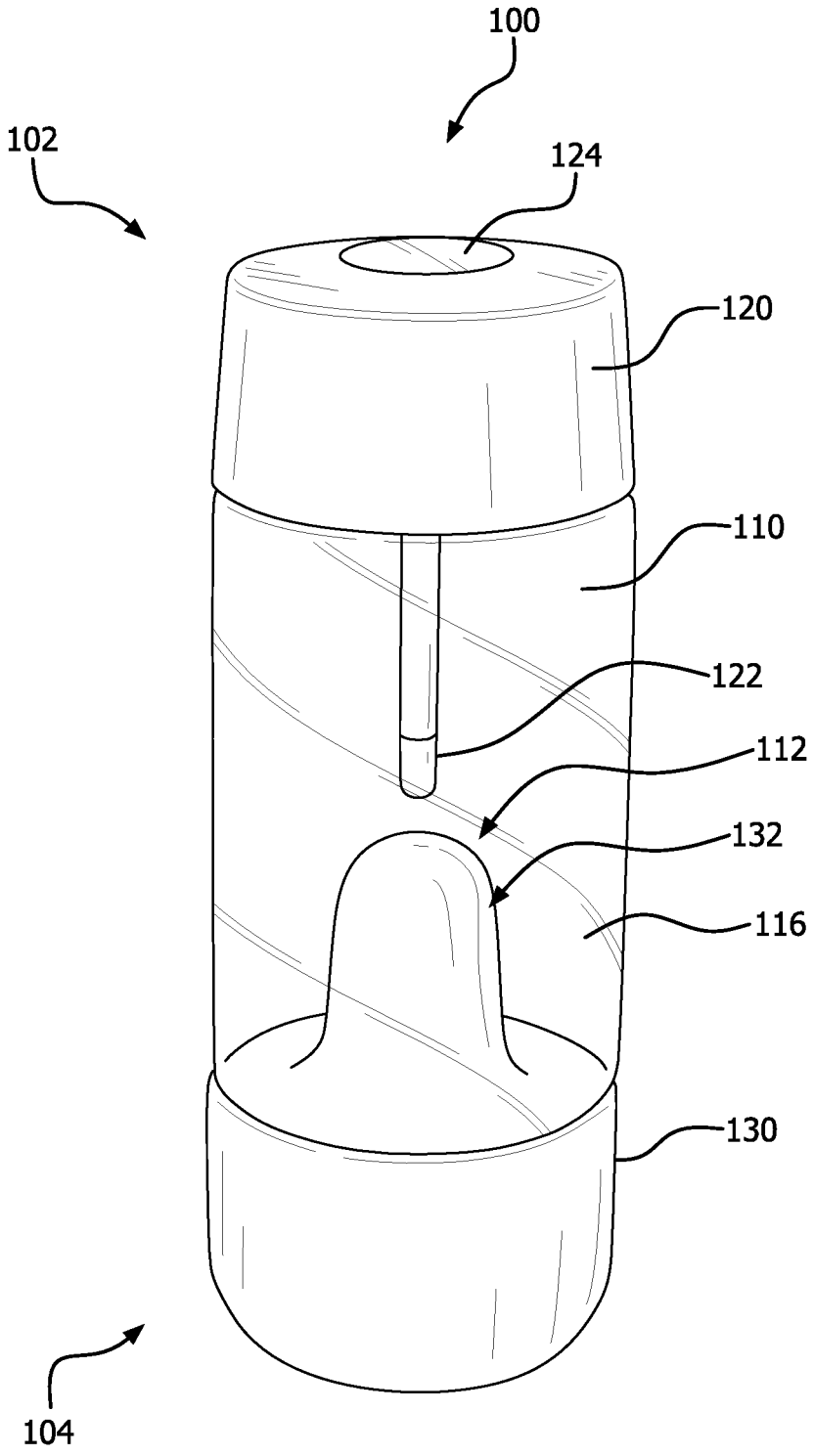
FIG. 1 is an elevated side view of an assembled container, cooling base and container cap according to one embodiment.

It is to be understood that the figures and descriptions of the present invention have been simplified to illustrate elements that are relevant for a more clear comprehension of the present invention, while eliminating, for the purpose of clarity, many other elements found in systems for storage, cooling and monitoring of breast milk. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are described.

As used herein, each of the following terms has the meaning associated with it in this section.

The articles "a" and "an" are used herein to refer to one or to more than one (i.e., to at least one) of the grammatical object of the article. By way of example, "an element" means one element or more than one element.

"About" as used herein when referring to a measurable value such as an amount, a temporal duration, and the like, is meant to encompass variations of ±20%, ±10%, ±5%, ±1%, and ±0.1% from the specified value, as such variations are appropriate.

Ranges: throughout this disclosure, various aspects of the invention can be presented in a range format. It should be understood that the description in range format is merely for convenience and brevity and should not be construed as an inflexible limitation on the scope of the invention. Where appropriate, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6, etc., as well as individual numbers within that range, for example, 1, 2, 2.7, 3, 4, 5, 5.3, and 6. This applies regardless of the breadth of the range.

Referring now in detail to the drawings, in which like reference numerals indicate like parts or elements throughout the several views, in various embodiments, presented herein is a system for storage, cooling and monitoring of breast milk.

Embodiments of the system for storing, cooling and monitoring breast milk described herein offer several advantages over conventional systems. The top to the system maintains a view of the thermometer display while simultaneously thermally insulating the container holding breast milk together with the cooling base. Combining a non-insulated cooling base within an insulated shell provides rapid cooling of the container's contents and longer duration of cool temperatures. Further, embodiments include a configuration which provides the benefit of measuring the coolest portion of the liquid, which is preferable for purposes of determining whether the breast milk temperature is being properly maintained. Still further, a bottom recess in the container advantageously decreases volume at the bottom of the container so that the probe tip is more likely to submerge in small-volumes of liquid if the mother pumps less than her normal amount, while simultaneously increasing surface area exposure between the cooling base and container to provide more efficient cooling.

Figure 2:
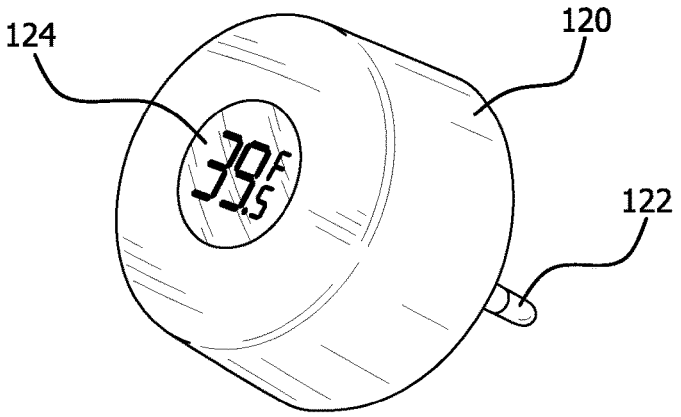
FIG. 2 is a perspective view of a top portion of the container cap and thermometer display according to one embodiment.
Figure 4:
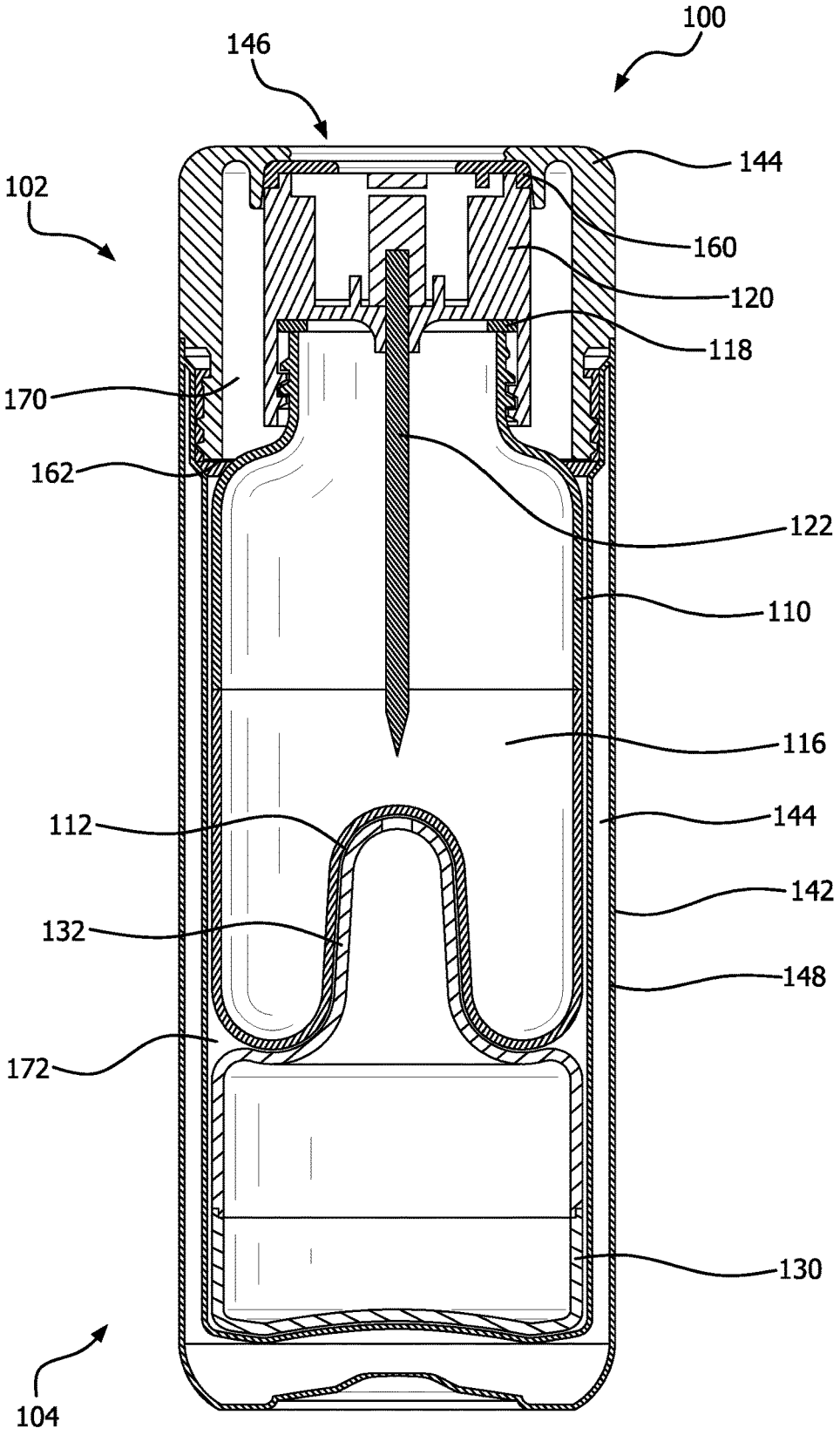
FIG. 4 is a cross-sectional side view of an assembled container, cooling base and container cap within a shell according to one embodiment.

With reference now to FIG. 1 and the cross-sectional view shown in FIG. 4, a system 100 for storing, cooling and monitoring breast milk according to one embodiment. The system 100 has a top 102 and bottom 104 end, and includes a container 110 having a top opening 118 (FIG. 4). A bottom recess 112 extends into an interior 116 of the container 110 towards the top opening 118. A non-insulated cooling base 130 has a protrusion 132 that assumes a shape similar to the recess 112 so that when the container 110 is resting on the base 130, the protrusion 132 mates within the recess 112. A screw on container cap 120 attaches to the container 110 and covers the top opening 118. The container cap 120 includes a probe thermometer having a sensing tip 122 positioned above the bottom recess 112 when the container cap 120 is attached to the container 110. As shown in FIG. 2, according to one embodiment, the container cap 120 includes a thermometer display 124 that shows temperature readings measured from the probe thermometer sensing tip 122.

Figure 3A:
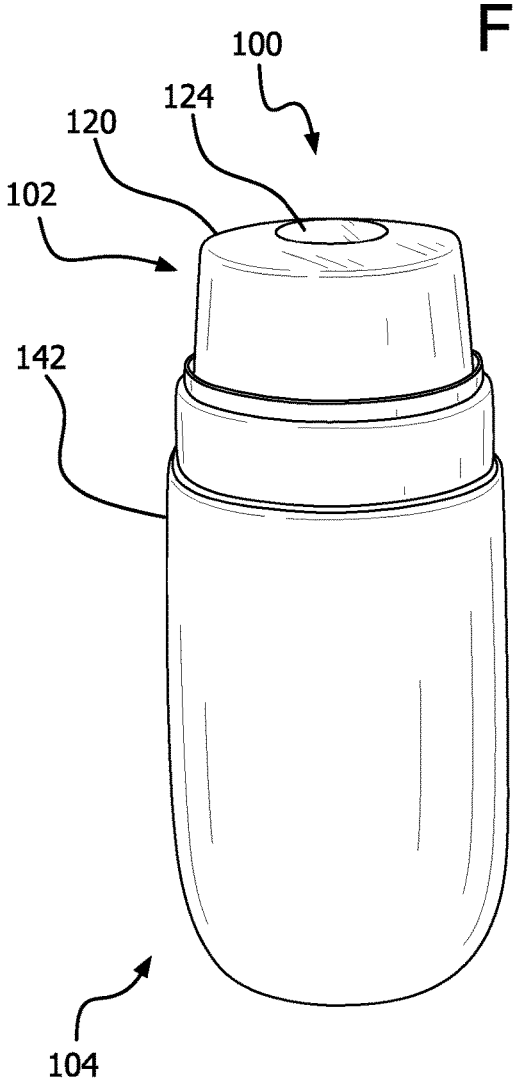
FIG. 3A is an elevated side view of the assembly of FIG. 1 within a bottom shell according to one embodiment.
Figure 3B:
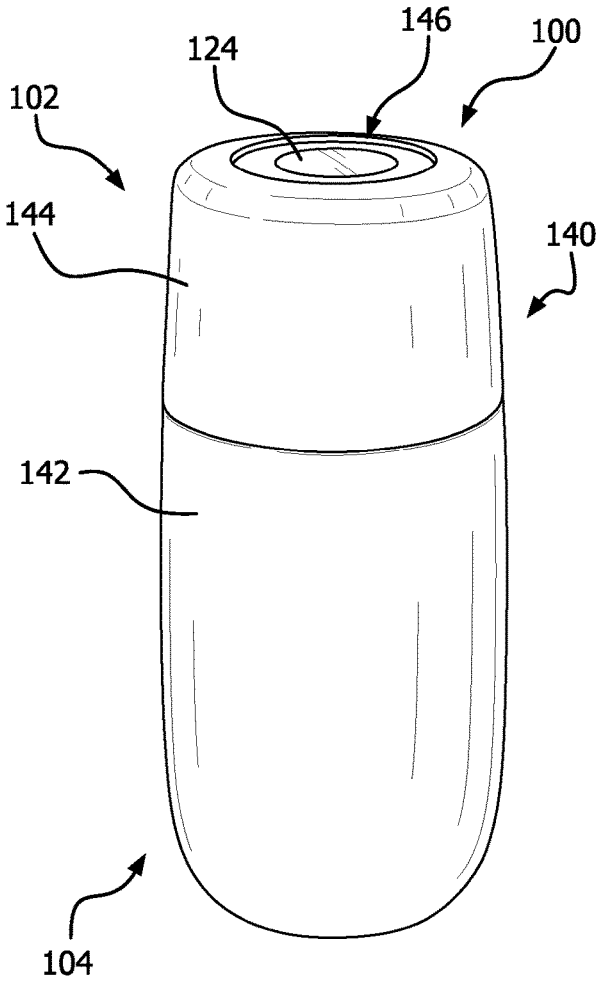
FIG. 3B is an elevated side view of the assembly of FIG. 3A with the top shell connected to the bottom shell according to one embodiment.
Figure 3C:
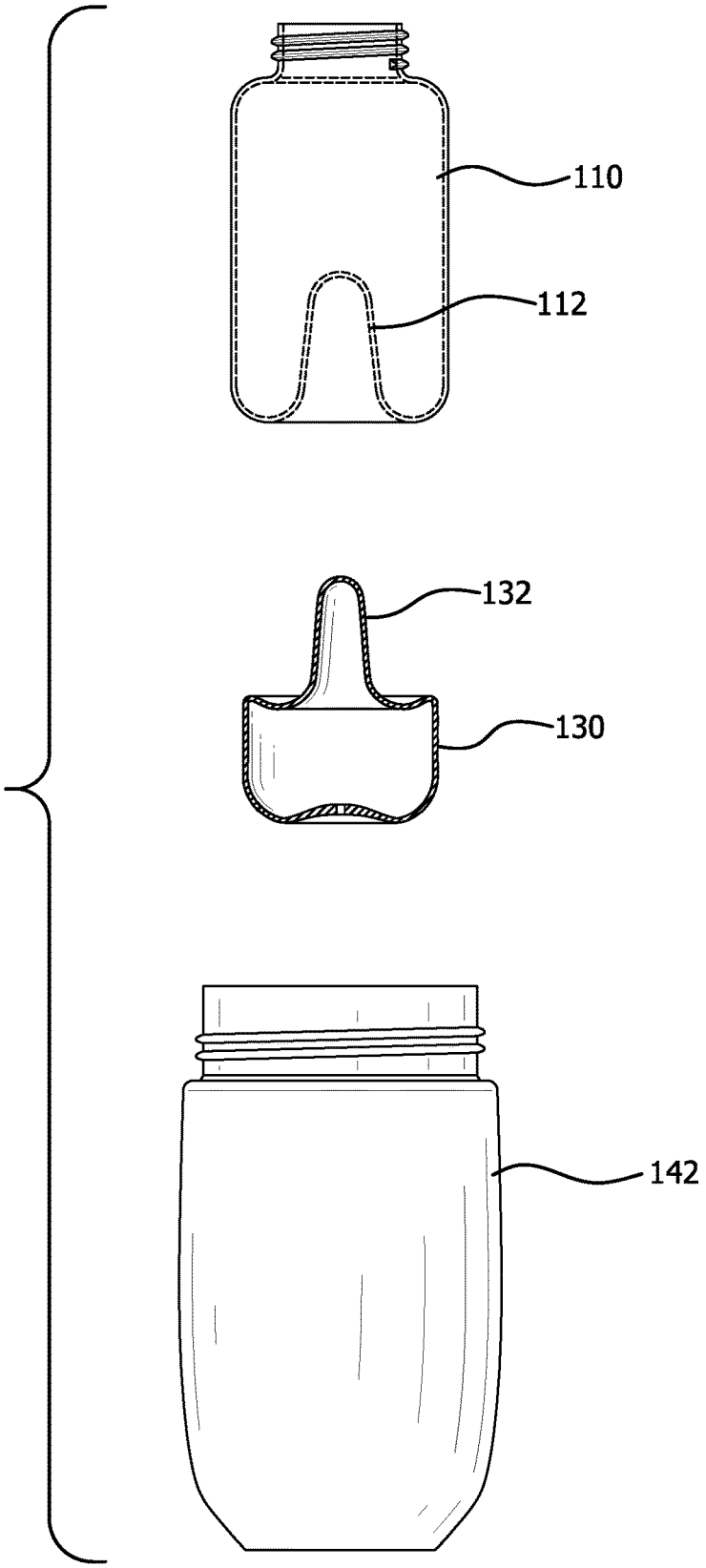
FIG. 3C is an exploded view of a the container, cooling base and bottom half of the insulating shell according to one embodiment. The cooling base interfaces with the bottom of the container, and together they fit within the bottom half of the insulating shell.

With additional reference now to FIGS. 3A and 3B, along with the cross-sectional view shown in FIG. 4, according to one embodiment, an insulated shell assembly 140 having a top 144 and bottom 142 can connect to each other so that the shell assembly 140 is configured to at least partially encapsulate the container 110, the container cap 120 and the cooling base 130. The shell top 144 has an opening 146 that at least partially or fully surrounds the display 124 when the shell assembly 140 is encapsulating the container 110, the container cap 120 and the cooling base 130. The shell top 144 is structured to include insulation contact points 160, 162 which contact at least one of the container 110 and container cap 120 to seal interior portions 170, 172 of the shell 140 from atmosphere when the shell assembly 140 is encapsulating the container 110, the container cap 120 and the cooling base 130. The shell top 144 can be structured to contact both the container 110 and container cap 120 to seal both top 170 and bottom 172 interior portions of the shell 140 from atmosphere when the shell assembly 140 is encapsulating the container 110, the container cap 120 and the cooling base 130. Advantageously, the shell top 144 maintains a view of the thermometer display 124 while simultaneously thermally insulating the container 110 and its contents together with the cooling base 130 to maintain cooling. As shown in FIG. 3C, an exploded view of a the container 110, cooling base 130 and bottom half of the insulating shell 142 illustrate that the components are created with dimensions to nest properly as an assembled unit. The geometry of the components can for example be rounded and tapered to ensure a proper fit and alignment. The cooling base 130 interfaces with the bottom of the container 110, and together they fit within the bottom half of the insulating shell 142.

The cooling base 130 can be stored in a freezer overnight to recharge. In one embodiment, the cooling base 130 includes a single bulk or layer of material. The material is preferably one that provides good heat transfer properties and is non-insulated, resulting in rapid cooling of the container 110. In one embodiment, the cooling base is a single layer of stainless steel. In one embodiment, the cooling base include an ice pack gel, beads or other cooling composition known in the art. The duration of cooling is maintained by the insulated shell assembly 140. In one embodiment, the shell assembly 140 includes two or more layers of material for providing thermal insulation. In one embodiment, the two or more layers include a stainless steel layer 148 and a vacuum insulation layer 144. In one embodiment, the container 110 is an 8 oz. bottle made from BPA-free high-grade plastic. In one embodiment, the container 110 can have a nipple attached to the top opening 118 for feeding the breast milk to a baby.

In one embodiment, the thermometer sensing tip 122 and bottom recess 112 of the container 110 are separated by between 0.5 cm and 3 cm when the container cap 120 is attached to the container 110. In one embodiment, the sensing tip 122 and bottom recess 112 are separated by between 0.5 cm and 2 cm when the container cap 120 is attached to the container 110. In one embodiment, the sensing tip 122 and bottom recess are separated by between 0.5 cm and 1 cm when the container cap 120 is attached to the container 110. This configuration provides the benefit of measuring the coolest portion of the liquid, which is preferable for purposes of determining whether the breast milk temperature is being properly maintained. Further, since mothers often only pump small amounts of breast milk, the container bottom recess 112 advantageously decreases volume at the bottom of the container 110 so that the probe tip 112 is more likely to submerge in the smaller volumes of liquid. Further, this design increases surface area exposure between the cooling base 130 and container 110, providing more efficient cooling.

In one embodiment, the protrusion 132 and recess 112 are configured to extend at least 2 cm into the interior of the container 110 when the container 110 is resting on the cooling base 130. In one embodiment, the protrusion 132 and recess 112 are configured to extend at least 3 cm into the interior of the container 110 when the container 110 is resting on the cooling base 130. In one embodiment, the protrusion 132 and recess 112 are configured to extend at least 4 cm into the interior of the container 110 when the container 110 is resting on the cooling base 130. In one embodiment, the protrusion 132 and recess 112 are configured to extend at least 5 cm into the interior of the container 110 when the container 110 is resting on the cooling base 130. In one embodiment, the protrusion 132 and recess 112 are configured to extend into at least 15% of the height of the interior 116 of the container 110 when the container 110 is resting on the cooling base 130. In one embodiment, the protrusion 132 and recess 112 are configured to extend into at least 20% of the height of the interior 116 of the container 110 when the container 110 is resting on the cooling base 130. In one embodiment, the protrusion 132 and recess 112 are configured to extend into at least 25% of the height of the interior 116 of the container 110 when the container 110 is resting on the cooling base 130. In one embodiment, the protrusion 132 and recess 112 are configured to extend into at least 30% of the height of the interior 116 of the container 110 when the container 110 is resting on the cooling base 130.

Figure 5:
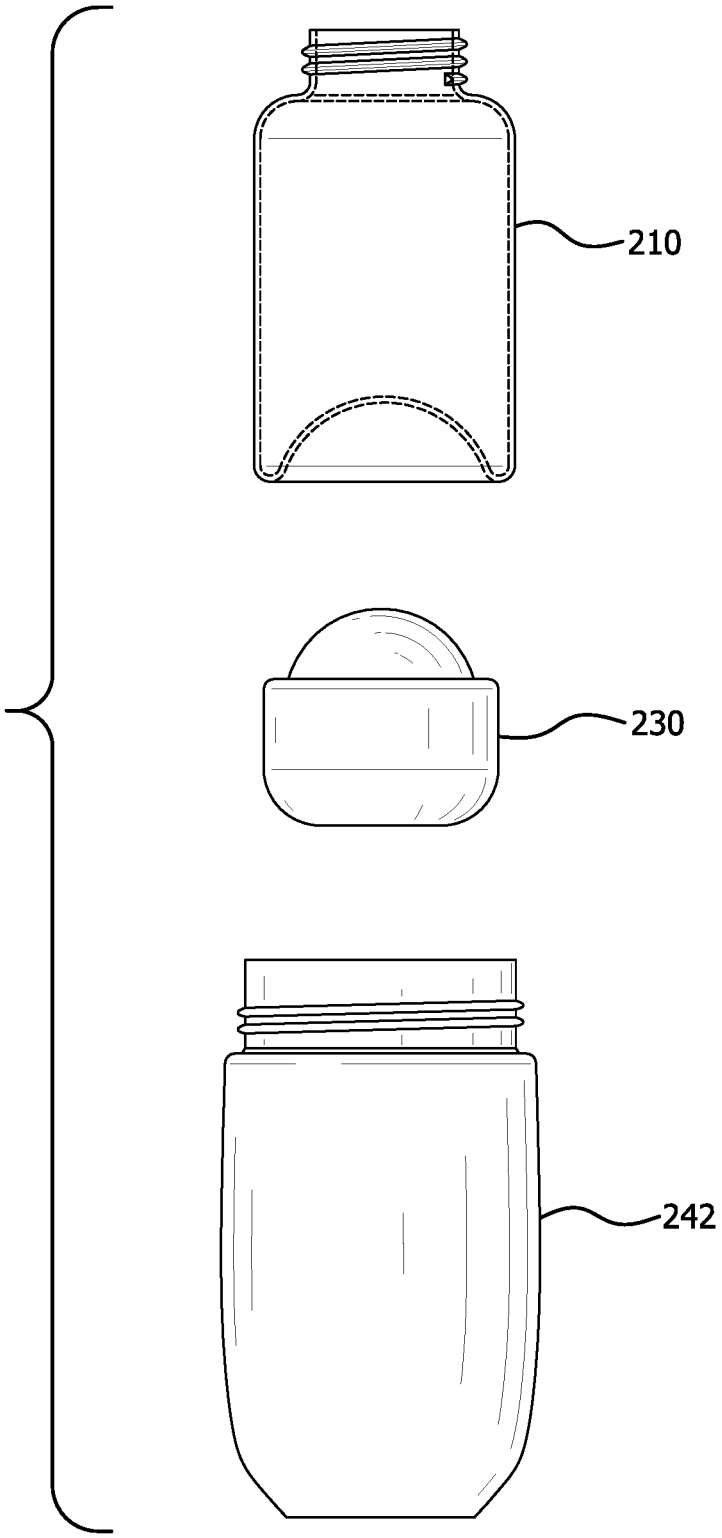
FIG. 5 shows an exploded view of a the container, cooling base and bottom half of an insulating shell according to one embodiment. The cooling base interfaces with the bottom of the container, and together they fit within the bottom half of the insulating shell.

With reference now to FIG. 5, an exploded view of a the container 210, cooling base 230 and bottom half of an insulating shell 242 are shown according to an alternate geometry. The cooling base 230 interfaces with the bottom of the container 210, and together they fit within the bottom half of the insulating shell 242. As illustrated by this embodiment, various container geometries can be implemented according to embodiments of the invention without deviating from the overall scope of the invention.

It should be appreciated that the embodiments described herein can use used for storage, cooling and monitoring of fluids other than breast milk, such as beverages or other types of liquids. It should also be appreciated that the thermal, insulative and heat transfer properties of the embodiments described herein can also be utilized to keep a beverage or liquid hot by heating instead of cooling the base.

EXPERIMENTAL EXAMPLES

The invention is now described with reference to the following Examples. These Examples are provided for the purpose of illustration only and the invention should in no way be construed as being limited to these Examples, but rather should be construed to encompass any and all variations which become evident as a result of the teaching provided herein.

Without further description, it is believed that one of ordinary skill in the art can, using the preceding description and the following illustrative examples, make and utilize the present invention and practice the claimed methods. The following working examples therefore, specifically point out the preferred embodiments of the present invention, and are not to be construed as limiting in any way the remainder of the disclosure.

Mathematical and computer analysis was conducted to simulate the cooling capabilities of an exemplary embodiment of the system as described above. The simulation assumed the following parameters: the container was essentially full with 8 ounces of milk starting at 98 degrees F., the specific heat and thermal conductivity of milk of whole cow's milk was relied upon, and a near-perfect vacuum insulation in the stainless-steel bottle (assumed around 5 mW/m-K) was assumed. The thermal conductivity of the stainless-steel bottle along with the thickness of the lid were optimized. Assuming an outside temperature of 74 degrees and close to perfect thermal conductivity in the stainless-steel bottle (a perfect vacuum), the system maintained safe temperatures below 59 degrees for 36 hours. At 114 degree outside temperatures, that time value drops to about 10 hours. At 100 degree outside temperatures, that time value is about 13.4 hours. Advantageously, embodiments of the system demonstrated the capability to safely store milk for 36 hours without relying on replenishing cooling components or use of ice cubes.

The disclosures of each and every patent, patent application, and publication cited herein are hereby incorporated herein by reference in their entirety. While this invention has been disclosed with reference to specific embodiments, it is apparent that other embodiments and variations of this invention may be devised by others skilled in the art without departing from the true spirit and scope of the invention.

What is claimed is:

1. A system for storing breast milk comprising:

a container comprising a top opening and a bottom recess extending into an interior of the container towards the top opening;

a container cap configured to attach to the container and cover the top opening, the container cap comprising a probe thermometer having a sensing tip positioned above the bottom recess when the container cap is attached to the container;

a non-insulated cooling base comprising a protrusion configured to mate within the recess when the container is resting on the base; and an insulated shell assembly comprising a top and bottom configured to connect to each other, wherein the shell assembly is configured to at least partially encapsulate the container, the container cap and the cooling base;

wherein the container cap comprises a thermometer display configured to display a temperature reading measured from the sensing tip; and wherein the shell top is configured to contact at least one of the container and container cap to seal an interior portion of the shell from atmosphere when the shell assembly is at least partially encapsulating the container, the container cap and the cooling base.

2. The system of claim 1, wherein the cooling base comprises a single layer of material.

3. The system of claim 2, wherein the material is stainless steel.

4. The system of claim 1, wherein the shell assembly comprises two or more layers of material.

5. The system of claim 4, wherein the two or more layers comprise a stainless steel layer and a vacuum insulation layer.

6. The system of claim 1, wherein the shell top is configured to contact at least one of the container and container cap to seal an interior portion of the shell from atmosphere when the shell assembly is at least partially encapsulating the container, the container cap and the cooling base.

7. The system of claim 1, wherein the shell top is configured to contact both the container and container cap to seal both top and bottom interior portions of the shell from atmosphere when the shell assembly is at least partially encapsulating the container, the container cap and the cooling base.

8. The system of claim 1, wherein the sensing tip and bottom recess are separated by between 0.5 cm and 3 cm when the container cap is attached to the container.

9. The system of claim 1, wherein the sensing tip and bottom recess are separated by between 0.5 cm and 2 cm when the container cap is attached to the container.

10. The system of claim 1, wherein the sensing tip and bottom recess are separated by between 0.5 cm and 1 cm when the container cap is attached to the container.

11. The system of claim 1, wherein the protrusion and recess are configured to extend at least 2 cm into the interior of the container when the container is resting on the cooling base.

12. The system of claim 1, wherein the protrusion and recess are configured to extend at least 3 cm into the interior of the container when the container is resting on the cooling base.

13. The system of claim 1, wherein the protrusion and recess are configured to extend at least 4 cm into the interior of the container when the container is resting on the cooling base.

14. The system of claim 1, wherein the protrusion and recess are configured to extend at least 5 cm into the interior of the container when the container is resting on the cooling base.

15. The system of claim 1, wherein the protrusion and recess are configured to extend into at least 20% of the height of the interior of the container when the container is resting on the cooling base.

16. The system of claim 1, wherein the protrusion and recess are configured to extend into at least 30% of the height of the interior of the container when the container is resting on the cooling base.

17. A system for storing breast milk comprising:

a container comprising a top opening;

a container cap configured to attach to the container and cover the top opening, the container cap comprising a probe thermometer having a sensing tip positioned within an interior of the container when the container cap is attached to the container and a thermometer display configured to display a temperature reading measured from the sensing tip;

a non-insulated cooling base; and an insulated shell assembly comprising a top and bottom configured to connect to each other, wherein the shell assembly is configured to at least partially encapsulate the container, the container cap and the cooling base;

wherein the shell top comprises an opening configured to at least partially surround the display, and wherein the shell top is configured to contact at least one of the container and container cap to seal an interior portion of the shell from atmosphere when the shell assembly is at least partially encapsulating the container, the container cap and the cooling base.

* * * * *